US011251003B2

(12) United States Patent
Chovanec et al.

(10) Patent No.: US 11,251,003 B2
(45) Date of Patent: Feb. 15, 2022

(54) INSULATING SUPPORT ASSEMBLY FOR A CIRCUIT BREAKER

(71) Applicant: General Electric Technology GmbH, Baden (CH)

(72) Inventors: Andrew Chovanec, Pittsburgh, PA (US); Victor F. Hermosillo, Bethel Park, PA (US); Chase Colton Peltier, Greensburg, PA (US)

(73) Assignee: General Electric Technology GmbH, Baden (CH)

( * ) Notice: Subject to any disclaimer, the term of this patent is extended or adjusted under 35 U.S.C. 154(b) by 0 days.

(21) Appl. No.: 17/091,924

(22) Filed: Nov. 6, 2020

(65) Prior Publication Data

US 2021/0134543 A1 May 6, 2021

(30) Foreign Application Priority Data

Nov. 6, 2019 (EP) ..... 19306438

(51) Int. Cl.
*H01H 33/02* (2006.01)
*H01H 33/64* (2006.01)

(52) U.S. Cl.
CPC ..... *H01H 33/02* (2013.01); *H01H 33/64* (2013.01)

(58) Field of Classification Search
CPC ..... H01H 33/02; H01H 33/64; H01H 33/70; H01H 1/385; H02B 5/06; H02B 13/035
USPC ..... 200/48 R, 400; 218/134, 13, 12, 51, 37, 218/55, 77, 79, 80, 119, 152
See application file for complete search history.

(56) References Cited

U.S. PATENT DOCUMENTS 3,816,682 A * 6/1974 MacBeth ..... H01H 33/82 218/72
4,107,498 A * 8/1978 Golota ..... H01H 31/32 218/80

(Continued)

FOREIGN PATENT DOCUMENTS

CN 201527862 U 7/2010
EP 2 390 887 A1 11/2011
JP H11-224576 A 8/1999

OTHER PUBLICATIONS

Search Report issued in European Application No. 19 30 6438, dated Apr. 7, 2020, 8 pages.

*Primary Examiner* — William A Bolton
(74) *Attorney, Agent, or Firm* — Eversheds Sutherland (US) LLP

(57) ABSTRACT

The application relates to certain embodiments of an improved insulating support assembly for a circuit breaker. One embodiment comprises a strut and two metallic shields. The strut comprises an elongated main body and two metallic inserts. The main body is continuously curved from one end to the other end of the main body, each end of the main body being configured to face a radial direction of its component, the main body being configured to be in a same plane as a plane containing both radial directions of the components; each metallic shield is configured to be assembled to its respective end of the main body through its respective metallic insert and affixed to an outer surface of its respective component with fixing elements, each metallic shield having a C-shaped profile shaped to accommodate the outer surface of its respective component.

14 Claims, 6 Drawing Sheets

(56) References Cited

U.S. PATENT DOCUMENTS

| | | | | |
|---|---|---|---|---|
| 4,748,303 | A * | 5/1988 | Kieffer | H01H 33/24 218/74 |
| 6,437,276 | B1 | 8/2002 | Bruchmann et al. | |
| 6,495,785 | B1 * | 12/2002 | Meyer | H01H 33/02 218/43 |
| 8,902,026 | B2 * | 12/2014 | Fujita | H01H 33/182 335/201 |
| 2011/0290624 | A1 | 12/2011 | Wuergler et al. | |

* cited by examiner

INSULATING SUPPORT ASSEMBLY FOR A CIRCUIT BREAKER

CROSS-REFERENCE TO RELATED APPLICATIONS

This application claims the priority benefit of European Application No. 19306438.3, filed Nov. 6, 2019, which is incorporated herein, in its entirety, by reference.

TECHNICAL FIELD

The present invention relates to a switching chamber insulation arrangement for a High Voltage (HV) circuit breaker. In particular, it relates to an improved insulator for support and alignment of a high-voltage circuit breaker interrupter.

STATE OF THE PRIOR ART

As well known, high-voltage circuit breakers are mechanical switching devices which connect and break current circuits. They contain one or more interrupter units and each interrupter unit has two sub-assemblies, each containing a contact pole. The two contact poles can be moved relative to one another between a connection position and a disconnection position in which the two contact poles are separated by a gap.

In order to provide electrical insulation, mechanical support and alignment between the two contact poles across the gap, an insulating support is necessary across the two sub-assemblies of the interrupter. This insulating support enables the implementation of a single, self-supporting interrupter that can be fully assembled and aligned on a bench and then inserted into a tank of a circuit breaker.

In most recent high-voltage circuit breaker interrupters (for example, in US 2011/0290624 A1 and as illustrated in FIG. 1), this insulating support is obtained by an arrangement of tubular insulation elements (struts 10, 20) which are set across the interrupter gap, their foot points 11, 21 and 13, 23 being attached to their respective contact poles 1, 2, for example by a screw connection. In the embodiment of the prior art illustrated in FIG. 1, the circuit breaker has a housing 101, which surrounds a gas area 9, two contact poles 1 and 2 of the circuit breaker which are located within this gas area and the first contact pole 1 has a moving part 1*a*, which can be moved axially along a longitudinal extent direction L. External metallic shields 4, 6 need to be placed above the foot point areas 11, 21, 13, 23 and connected in a conductive manner via a conductive connection 5, 7 to the corresponding contact poles 1, 2 to control the field peaks caused by the screw edges 8. Such an addition increases the interrupter diameter and, consequently, the diameter of the grounded enclosure of dead-tank and GIS circuit breakers. FIG. 2 shows another exemplary embodiment of the prior art with an arrangement of four struts 10, 20, 30, 40, arranged along a circumference U and configured to be assembled to their respective contact pole along this circumference U (in the direction of the bold arrows, which are parallel to the longitudinal L direction).

Such insulation support in the form of a strut or arrangement of a plurality of struts offers the advantage of not enclosing the interrupter gap, allowing for particulates generated by the interrupter during breaker operation to exit the zone of the interrupter gap and fall on the inner surface of the grounded housing of the tank.

However, there is a need for an improved insulating support that can provide the functions of a gap insulator, i.e. electrical insulation, alignment and mechanical support necessary between both sides of the sub-assemblies of the interrupter, while maintaining a minimum radial dimension of the interrupter and of the tank.

Such improved insulating support could also be used to provide electrical insulation and mechanical support between other parallel components of a circuit breaker, while maintaining a minimum radial dimension of the thus connected components.

DISCLOSURE OF THE INVENTION

An object of the present invention is an insulating support assembly configured to provide mechanical support and electrical insulation between two components of a circuit breaker, the insulating support assembly comprising a strut and two metallic shields, the strut comprising:

an elongated main body made of a vacuum casted epoxy resin having two ends; and two metallic inserts, each insert being partially embedded in its respective end of the main body;

the assembly being characterized in that the main body is continuously curved with a curvature extending from one end to the other end of the main body, each end of the main body being configured to face a radial direction of the component on which it is to be fixed, and the main body being configured to be in a same plane as a plane containing both radial directions of the components; and in that each metallic shield is configured to be assembled to its respective end of the main body through its respective metallic insert and affixed to an outer surface of its respective component of the circuit breaker by means of fixing elements, each metallic shield having a C-shaped or substantially C-shaped profile shaped to accommodate the outer surface of its respective component. In other words, each metallic shield is shaped to fit the outer surface of its respective component, so as each metallic shield can be affixed to the outer surface of its respective component.

Preferably, the curvature of the main body is constant.

Preferably, the elongated main body has a C-shaped or substantially C-shaped profile.

According to a first variant of the invention, the elongated main body having a C-shaped or substantially C-shaped profile, the C-shaped or substantially C-shaped profiles of the shields are parallel and the plans containing the C-shaped or substantially C-shaped profiles of the shields are oriented at an angle of 90° with respect to the plane containing the C-shaped or substantially C-shaped profile of the main body.

According to a second variant of the invention, the elongated main body having a C-shaped or substantially C-shaped profile, one of the two C-shaped or substantially C-shaped profiles of the shields and the C-shaped or substantially C-shaped profile of the main body are in a same plane and this plane is oriented to an angle of 90° with respect to a plane containing the other one of the two C-shaped or substantially C-shaped profiles of the shields.

Preferably, an angle θ (see for example in FIG. 9) between the two ends of the main body is comprised between 60° and 180° inclusive; preferably, the angle is comprised between 120° and 180° inclusive when the assembly has to provide mechanical support and electrical insulation between two interrupter sub-assemblies and between 60° and 120° inclusive when the assembly has to provide mechanical support and electrical insulation between a circuit breaker contact and a component which is a grading capacitor or a pre-insertion resistor.

According to particular embodiments:

- a smallest dimension of a cross section of the main body is larger than a largest dimension of a cross section of its respective metallic insert;
- at least one metallic shield and its respective metallic insert are integrated into a single metallic element;
- the elongated main body has an ovoid or circular cross section.

Another object of the present invention is a circuit breaker insulation arrangement comprising at least one insulating support assembly according to the invention and two components of a circuit breaker, wherein the two components are two interrupter sub-assemblies, each interrupter sub-assembly containing a switch contact pole. In such configuration, the insulating support assembly provides mechanical support, alignment and insulation between the two switch contact poles across the interrupter gap. The two components might be spaced apart and arranged along the same longitudinal axis.

Preferably, the circuit breaker insulation arrangement comprises at least three insulating support assemblies.

Another object of the present invention is a circuit breaker insulation arrangement comprising at least one insulating support assembly according to the invention and two components of a circuit breaker, wherein one of the two components is a circuit breaker contact and the other one of the two components is a grading capacitor, a surge arrester or a pre-insertion resistor. Such a configuration is adapted, for example, for fitting a pre-insertion resistor with an additional insertion contact, the pre-insertion resistor and the insertion contact being connected in series with one or more insulating support assemblies. The two components might be adjacent, the longitudinal axis of one of the two components being parallel to the longitudinal axis of the other one of the two components.

Preferably, according to particular embodiments in the circuit breaker insulation arrangement as described above (wherein the two components are either two interrupter sub-assemblies, each containing a switch contact pole, or a circuit breaker contact and a grading capacitor or pre-insertion resistor):

- each metallic insert is assembled, through its respective metallic shield, on the outer surface of its respective component in a radial direction of said component;
- the metallic shields have through-holes for accommodating fixing elements (such as screws or bolts) and the metallic shields are attached to their respective components by the fixing elements, each fixing element being recessed in its through-hole so as not to protrude from a surface of its respective metallic shield;
- at least one metallic shield (15) is housed in a recess in the outer surface of its respective component of the circuit breaker.

Additional features and advantages of the present invention are described in, and will be apparent from, the detailed description of the preferred embodiments, the figures and the claims.

DETAILED DESCRIPTION OF PREFERRED EMBODIMENTS OF THE INVENTION

The insulating support assembly according to the invention can be used to provide mechanical support, as well as alignment and insulation across two components of a circuit breaker.

For example, it can be used to connect two interrupter sub-assemblies, each interrupter sub-assembly containing a switch contact pole, in order to connect the two contact poles across the interrupter gap. Accordingly, the insulating support assembly according to the invention can be used as a gap insulator to provide mechanical support, alignment and electrical insulation across the interrupter gap, while maintaining a minimum radial dimension of the interrupter and of the tank. It allows for a reduction in costs of the interrupter and the tank as a result of smaller radial dimensions. Furthermore, the curved form of the strut increases the strike distance and creepage distance, improving performance under polluted conditions.

Figure 1:
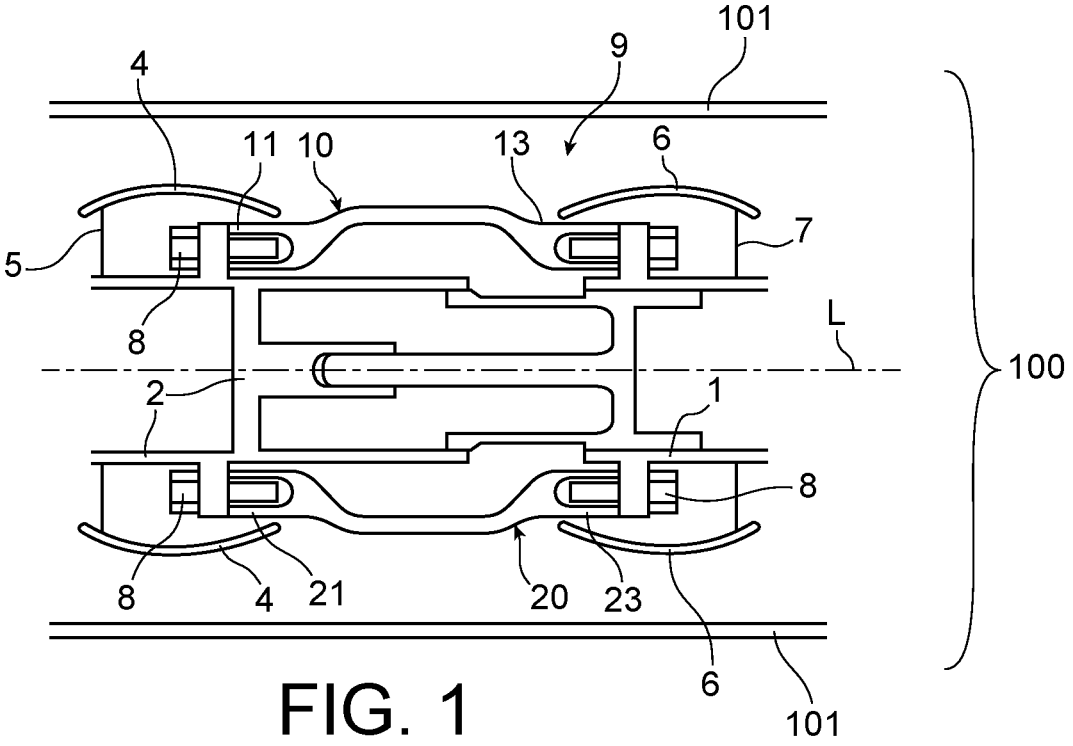
FIG. 1 PRIOR ART
FIG. 1, already described, shows a section view through an area of a gas-insulated circuit breaker according to an exemplary embodiment of the prior art.
Figure 2:
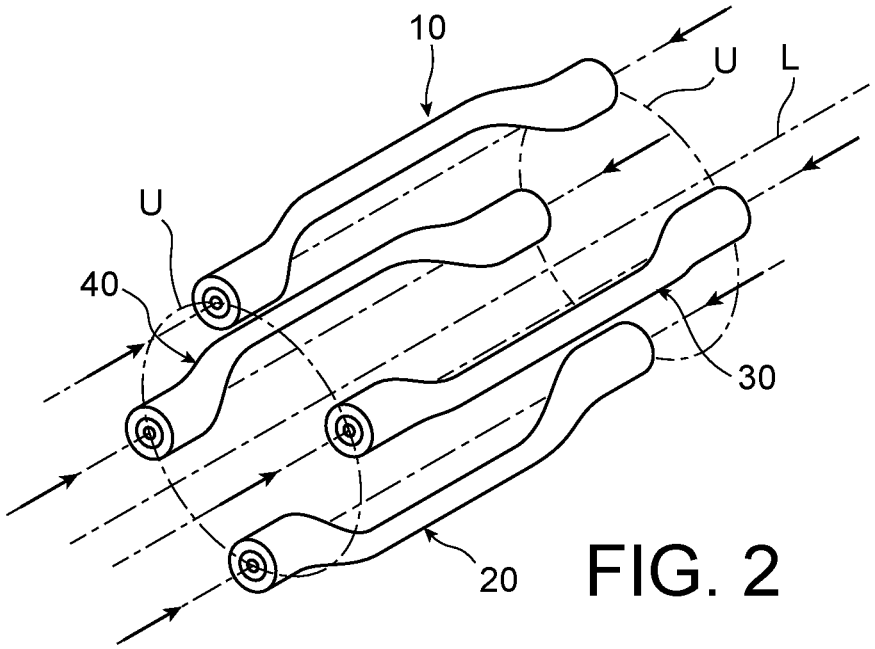
FIG. 2 PRIOR ART
FIG. 2, already described, shows a switching chamber arrangement according to an exemplary embodiment of the prior art.
Figure 3:
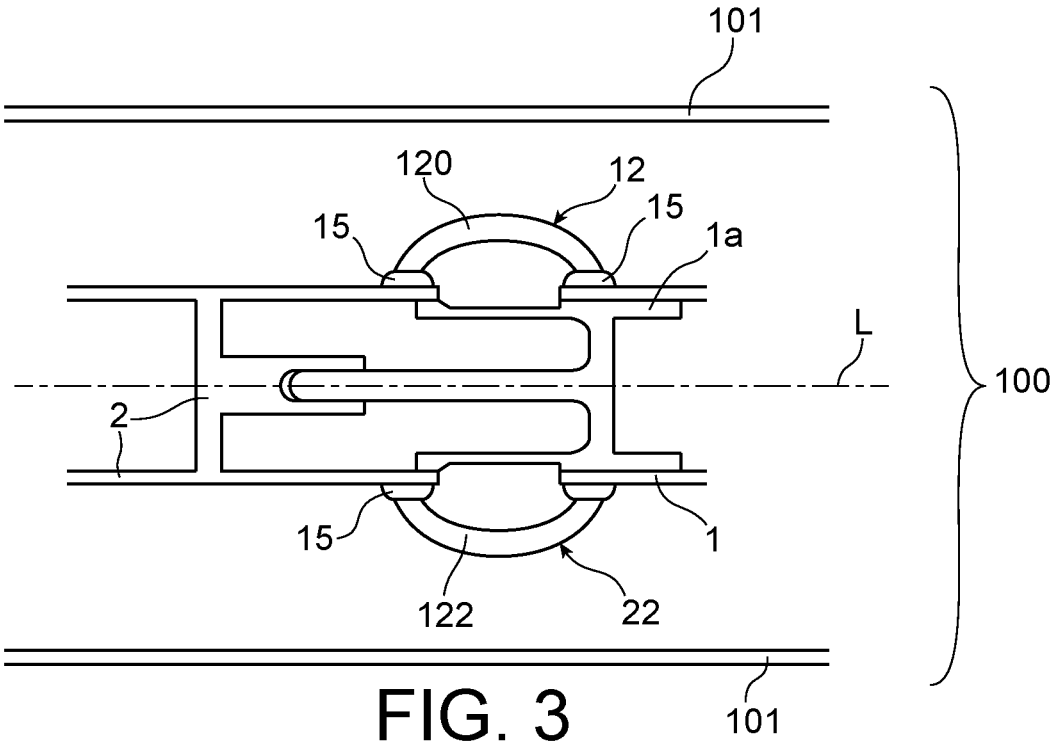
FIG. 3 shows a section view through an area of a gas-insulated circuit breaker according to an exemplary embodiment of the invention.

As illustrated in FIG. 3, a plurality of insulating support assemblies according to the invention can be used to connect to interrupter sub-assemblies 1, 2. In this embodiment, two insulating support assemblies 12, 22 are arranged across the interrupter gap and the metallic shields are fixed around the perimeter of the interrupter sub-assemblies 1, 2.

Figure 4:
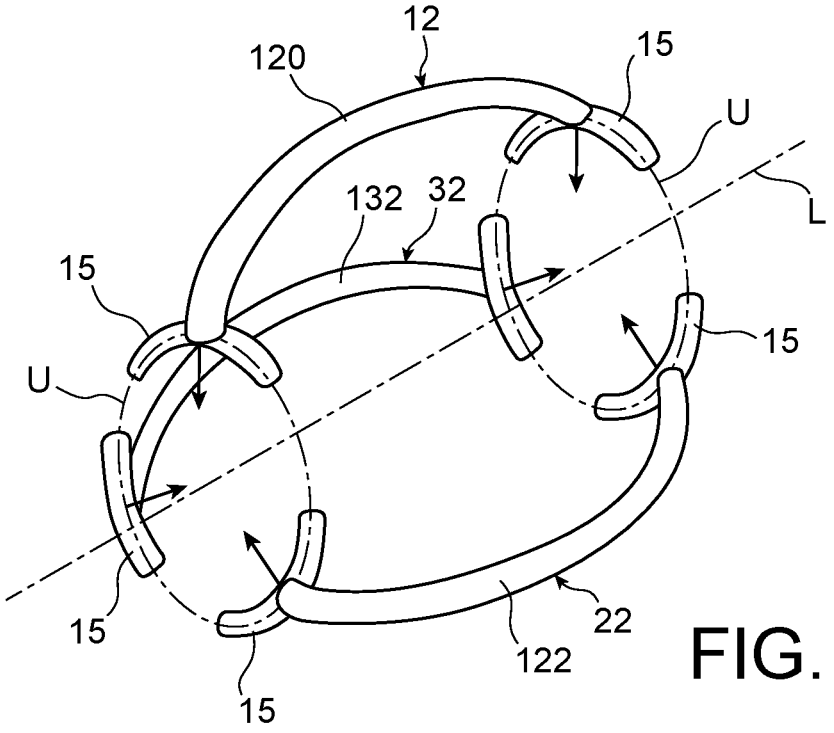
FIG. 4 shows a switching chamber arrangement of a plurality of insulating support assemblies according to an exemplary embodiment of the invention.

In FIG. 4 is illustrated another exemplary of an arrangement according to the invention of three insulating support assemblies 12, 22, 32, each insulating support assembly 12, 22, 32 comprising a strut 120, 122, 132 and two metallic shields 15. The metallic shields 15 are arranged along a circumference U and configured to be assembled and fixed to their respective components (here interrupter sub-assemblies) along this circumference U (in the direction of the bold arrows, which are oriented in a radial direction relative to the longitudinal L direction).

Figure 5:
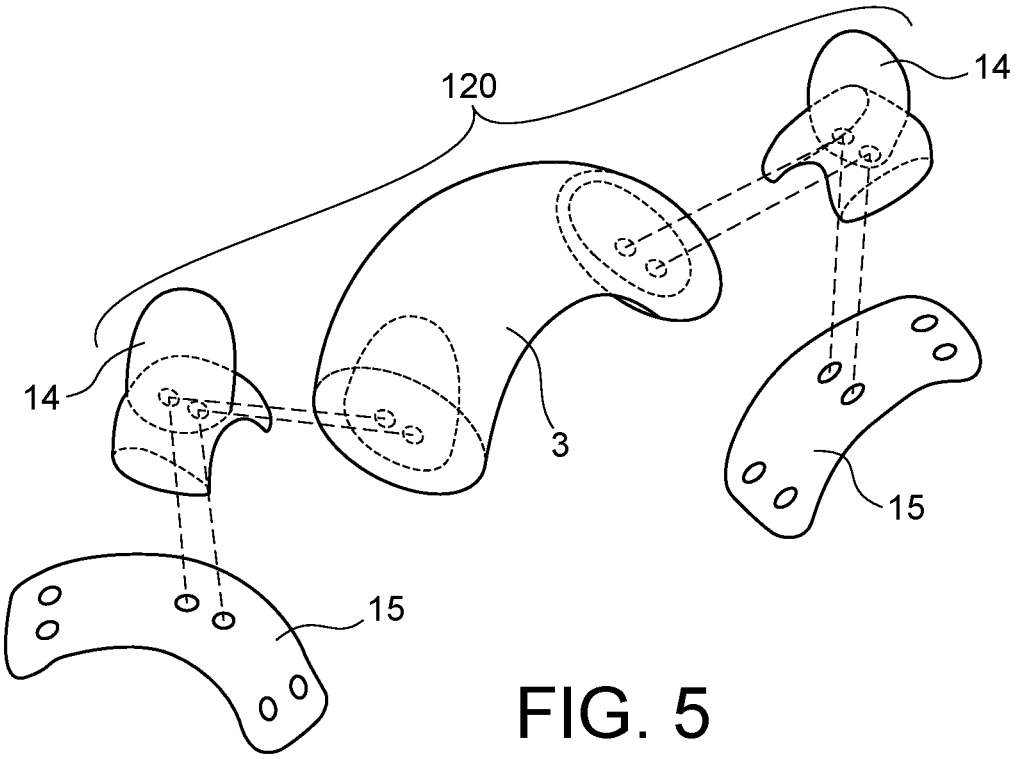
FIG. 5 shows an exploded view of an insulating support assembly according to an exemplary embodiment of the invention.

As illustrated in FIG. 5, the insulating support assembly 12 according to the invention comprises a strut 120 and two metallic shields 15. The strut 120 comprises an electrically insulating curved main body 3, made of a vacuum casted epoxy resin, and two metallic inserts 14, each insert being partially embedded at one end of the main body. Each metallic shield 15 is configured to be assembled with its respective metallic insert 14 on an outer surface of a component 1, 2 of a circuit breaker 100. The shield and the insert comprise holes or through-holes 17 for the insertion of fixing elements such as bolts or screws.

The two metallic inserts 14 are included in the casting process of the main body 3 so that they are partially integrated in the main body.

If a metallic insert 14 and its respective shield 15 are two separate elements, the shield and the insert are assembled together, for example bolted together, and the shield is then assembled on the outer surface of its respective component.

Figure 6:
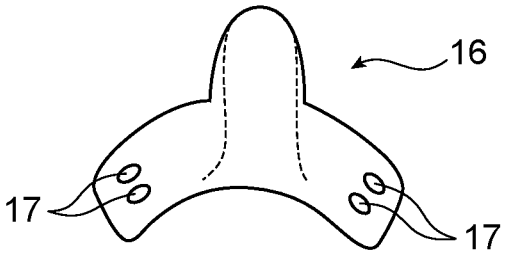
FIG. 6 shows an exemplary embodiment according to the invention of a metallic shield and its respective metallic insert integrated in a single metallic element.

In a variant illustrated in FIG. 6, the insert and its respective shield can also be integrated into a single piece 16. An advantage of an integrated insert is that the insulating support assembly can be assembled on the outer surface of the component from the outer side of the component that it is intended to be joined to and support.

The metallic shields 15 are used to fix the end of the inserts 14 on a component of a circuit breaker by means of fixing elements (such as bolts or screws), but they also serve as shields for the heads of the fixing elements against fuel peaks. Indeed, the fixing elements are inserted into holes 17 provided in the shields, so that the heads of the fixing elements are recessed in the shields and do not protrude from them. The fixing elements are thus shielded inside the shield body and the resulting electric field intensity is reduced. The preferred shape for the head of the fixing element is cylindrical (socket head type), which allows it to be recessed in a round countersunk hole.

The metallic shields are configured to be affixed to the outer surface of the component on which it is to be fixed. Since the components have generally a tubular form, the shields will thus usually have a C-shaped profile. The profiles of two shields (for example C-shaped profiles) of a same strut can be oriented parallel to each other or differently, if necessary, depending on the orientation of the two components to be connected, in order to adapt to the profile of the outer surfaces of the components on which they are to be affixed. For example, as illustrated in FIG. 4, the C-shaped profiles of the shields 15 are parallel and the plans containing the C-shaped profiles of the shields are oriented at an angle of 90° with respect to the plane containing the C-shaped profile of the main body of the strut. In another example illustrated in FIG. 5, the C-shaped profile of one of the shields is parallel to the C-shaped profile of the main body and the plans of the C-shaped profiles of this shield and the main body are oriented at an angle of 90° with respect to the plane of the C-shaped profile of the other one of the shields.

As illustrated in FIG. 7, FIG. 8*a*, FIG. 8*b* and FIG. 9, the main body 3 of the strut 120 is elongated and curved with a curvature 18 extending from one end of the main body to the other end and there is a metallic insert 14 partially embedded at each end of the main body.

Preferably, the main body of the strut has a C shape. The C shape actually allows for shorter spacing between the two shields 15, and thus between the two components to be joined by the strut, while still keeping a long distance along the insulator surface of the main body. This distance is important in order to avoid surface tracking under a voltage stress when the insulating support assembly is operating in polluted conditions. Indeed, in a circuit breaker, in particular in a circuit breaker which interrupts high-current magnitudes at high operating voltage, the breaking of currents creates decomposition products in the gas that is used for interruption and these form solid compounds that deposit on surfaces inside the circuit breaker, including on the surface of the main body of the strut.

The main body 3 of the strut is made of an electrically insulating material, in particular a casted epoxy resin. Epoxy resin is the material that is most commonly used for solid electrical insulation in switchgear. In particular, it is used in Gas-Insulated Substations and in Metal Enclosed (dead-tank) circuit breakers. The epoxy resin is casted in a mold under a vacuum process in order to avoid voids or cavities in the material.

The main body can have an ovoid or a circular cross section shape. The ovoid shape provides more mechanical strength in the direction in which the cross section is greater.

Figure 7:
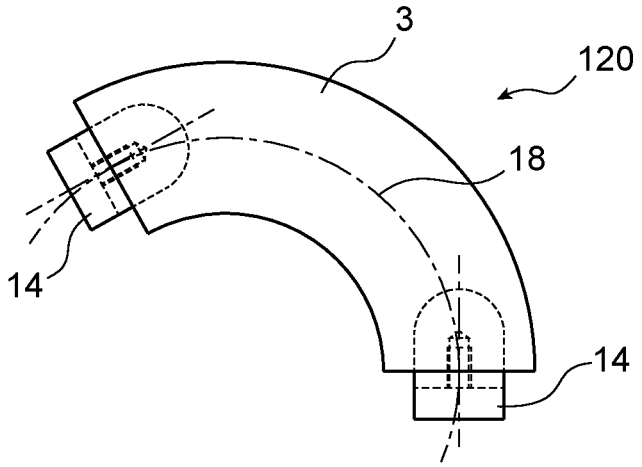
FIG. 7 shows a perspective top view of a strut according to an exemplary embodiment of the invention.
Figure 8A:
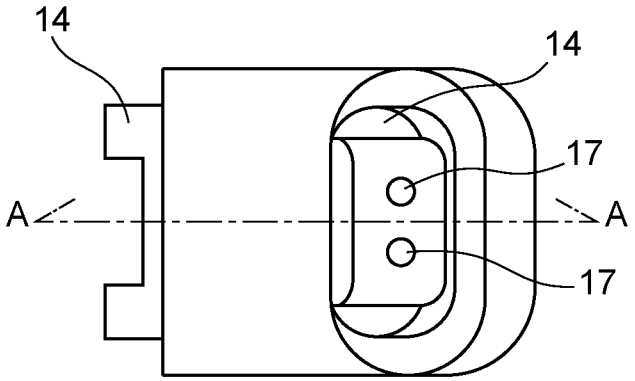
FIG. 8*a* shows a perspective lateral view of the strut illustrated in FIG. 7.
Figure 8B:
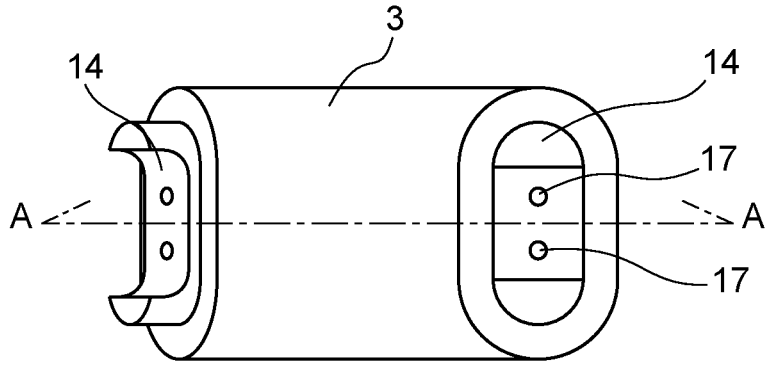
FIG. 8*b* shows another perspective lateral view of the strut illustrated in FIG. 7.
Figure 9:
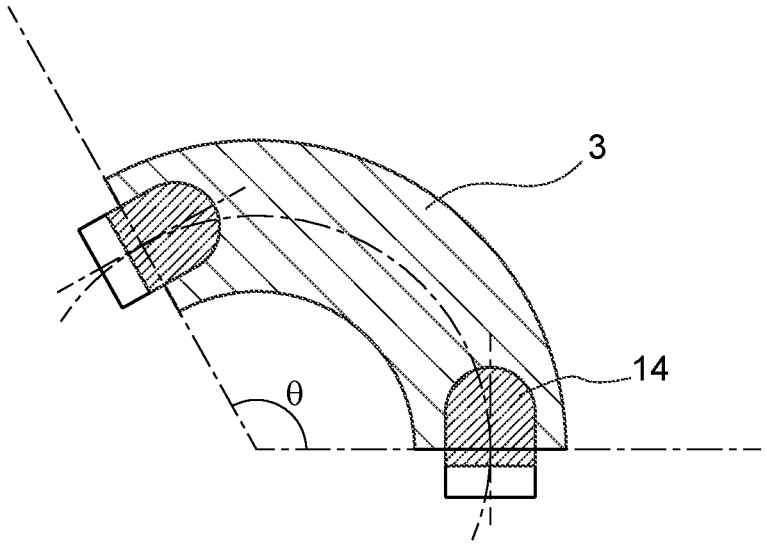
FIG. 9 shows a cross-sectional view as seen along plane A-A of the strut illustrated in FIG. 8*a* and FIG. 8*b;*

As illustrated in FIG. 7, FIG. 8*a* and FIG. 8*b*, the smallest dimension of the cross section of the main body is preferably greater than the greatest dimension of the cross section of the metallic insert 14. This configuration ensures that triple points are not protruding. As a reminder, triple points are regions where a solid dielectric material, a metal and a gas meet and these regions are very prone to electron emission under voltage. The configuration of the end fitting is such that the triple point is hidden behind the metal piece incorporated into the epoxy.

Figure 10:
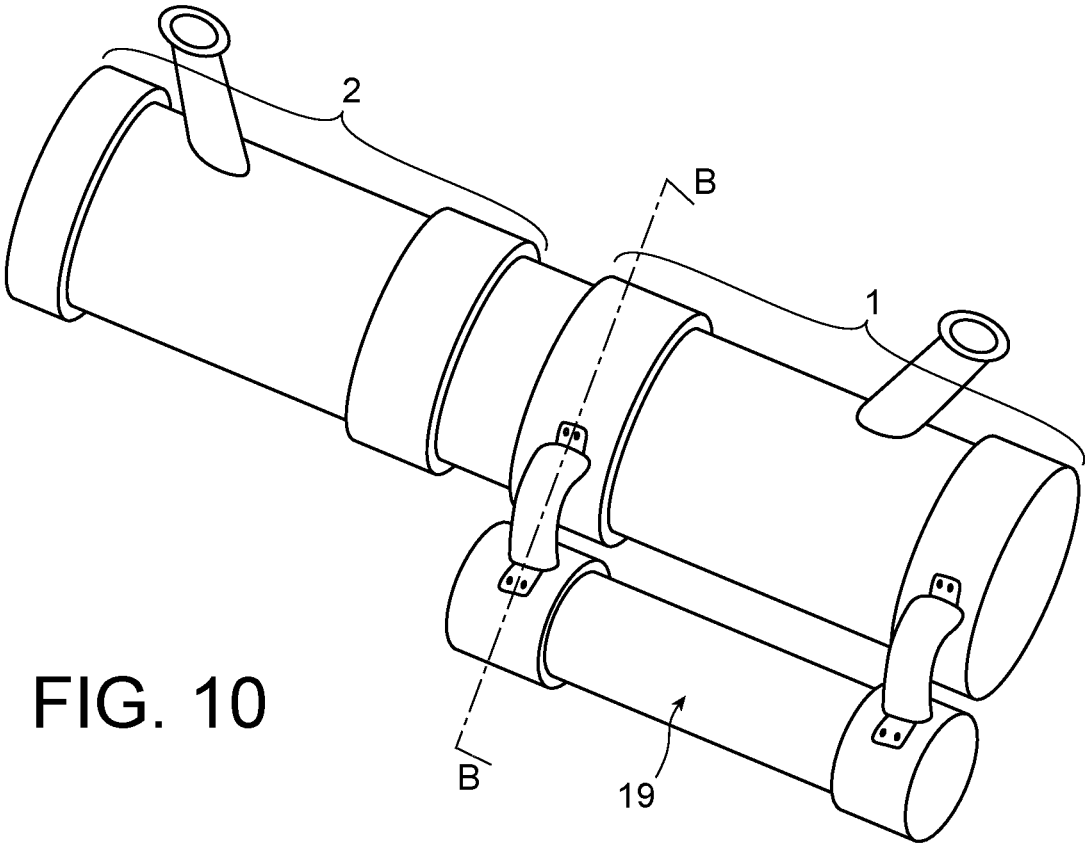
FIG. 10 shows a perspective lateral view of a circuit breaker insulation arrangement wherein a circuit breaker contact is connected to an element which is a grading capacitor or a pre-insertion resistor.

As illustrated in FIG. 10, the insulating support assemblies according to the invention can also be used to provide mechanical support to a graded capacitor 19 on an interrupter sub-assembly 1 (contact pole) in a high-voltage gas-insulated metal-enclosed circuit breaker. One can note that the configuration illustrated in FIG. 5 is used here to connect the graded capacitor on the contact pole.

A metallic shield 15 can be affixed on the outer surface of a component. Another option is to recess the entire metallic shield into the outer surface of the component. In the embodiment illustrated in FIG. 11, one of the two metallic shields is affixed on the outer surface of the interrupter sub-assembly 1 and the other shield is recessed into the metal housing of the grading capacitor 19.

Figure 11:
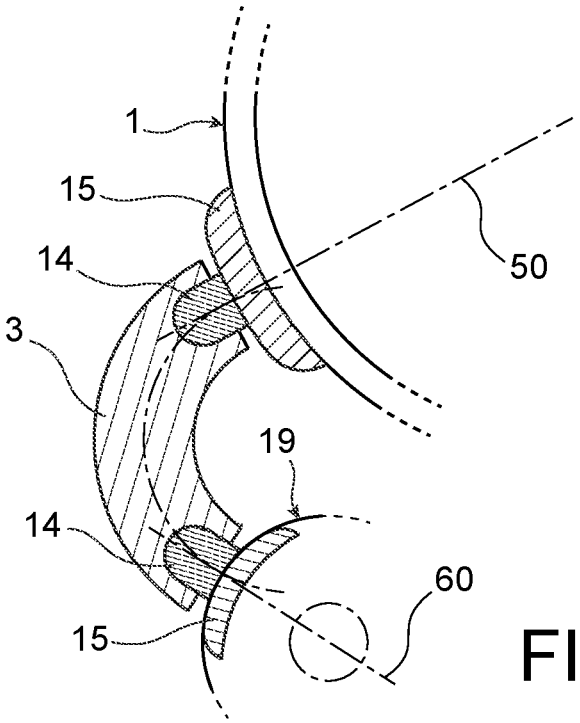
FIG. 11 shows a cross-sectional detail view of the arrangement illustrated in FIG. 10 as seen along plane B-B.

One can note that one end of the main body 3 faces the radial direction 50 of the interrupter sub-assembly 1 and the other end of the main body 3 faces the radial direction 60 of the grading capacitor 19. Preferably, as illustrated in FIG. 11, the ends of the curved main body 3 have a 90° angle relative to the radial direction of its respective component.

According to another embodiment, the grading capacitor 19 could be replaced with a pre-insertion resistor.

Preferably, the exposed surface of a shield 15 follows the contour of the outer surface of the component on which it is affixed and its perimeter is rounded to reduce the electric field intensity.

The invention claimed is:

1. An insulating support assembly configured to provide mechanical support and electrical insulation between two components of a circuit breaker, the insulating support assembly comprising a strut and two metallic shields, the strut comprising:

an elongated main body made of a vacuum casted epoxy resin having two ends; and two metallic inserts, each insert being partially embedded in a respective end of the main body;

wherein the main body is continuously curved with a curvature extending from one end to the other end of the main body, each end of the main body being configured to face a radial direction of the respective component, and the main body being configured to be in a same plane as a plane containing both radial directions of the components; and wherein each metallic shield is configured to be assembled to the respective end of the main body through the respective metallic insert and affixed to an outer surface of the respective component of the circuit breaker by means of fixing elements, each metallic shield having a C-shaped or substantially C-shaped profile shaped to accommodate the outer surface of the respective component.

2. The insulating support assembly according to claim 1, wherein the elongated main body has a C-shaped or substantially C-shaped profile.

3. The insulating support assembly according to claim 2, wherein the C-shaped or substantially C-shaped profiles of the shields are parallel and planes containing the C-shaped or substantially C-shaped profiles of the shields are oriented at an angle of 90° with respect to a plane containing the C-shaped or substantially C-shaped profile of the main body.

4. The insulating support assembly according to claim 2, wherein one of the two C-shaped or substantially C-shaped profiles of the shields and the C-shaped or substantially C-shaped profile of the main body are in a same plane and this plane is oriented to an angle of 90° with respect to a plane containing the other one of the two C-shaped or substantially C-shaped profiles of the shields.

5. The insulating support assembly according to claim 1, wherein an angle θ between the two ends of the main body is comprised between 60° and 180° inclusive.

6. The insulating support assembly according to claim 1, wherein a smallest dimension of a cross section of the main body is larger than a largest dimension of a cross section of the respective metallic insert.

7. The insulating support assembly according to claim 1, wherein at least one metallic shield and the respective metallic insert are integrated into a single metallic element.

8. The insulating support assembly according to claim 1, wherein the elongated main body has an ovoid or circular cross section.

9. The circuit breaker insulation arrangement according to claim 1, comprising at least one insulating support assembly and two components of a circuit breaker, wherein each metallic insert is assembled, through the respective metallic shield, on the outer surface of its respective component in a radial direction of said component.

10. The circuit breaker insulation arrangement according to claim 9, wherein the metallic shields have through-holes for accommodating fixing elements and are attached to the respective components by the fixing elements, each fixing element being recessed in a through-hole so as not to protrude from a surface of the respective metallic shield.

11. The circuit breaker insulation arrangement according to claim 9, wherein at least one metallic shield is housed in a recess in the outer surface of the respective component of the circuit breaker.

12. The circuit breaker insulation arrangement according to claim 9, wherein the two components are two interrupter sub-assemblies, each interrupter sub-assembly containing a switch contact pole.

13. The circuit breaker insulation arrangement according to claim 12, comprising at least three insulating support assemblies.

14. The circuit breaker insulation arrangement according to claim 9, wherein one of the two components is a circuit breaker contact and the other one of the two components is a grading capacitor or a pre-insertion resistor.

* * * * *